United States Patent [19]

Crain et al.

[11] 4,249,339

[45] Feb. 10, 1981

[54] SPACE TOY

[75] Inventors: Philip W. Crain, San Pedro; William J. Kelley; Daniel J. Shoff, both of Torrance, Calif.

[73] Assignee: Mattel, Inc., Hawthorne, Calif.

[21] Appl. No.: 12,922

[22] Filed: Feb. 16, 1979

[51] Int. Cl.[3] ..... A63H 33/26

[52] U.S. Cl. ..... 46/232; 46/111; 46/74 B

[58] Field of Search ..... 46/232, 227, 202, 111, 46/112, 174, 175 R

[56] References Cited

U.S. PATENT DOCUMENTS

| | | | |
|---|---|---|---|
| 3,071,895 | 1/1963 | Gelfand et al. | 46/227 X |
| 3,394,491 | 7/1968 | Valentine | 46/232 X |
| 3,591,978 | 7/1971 | Bollman | 46/175 R |
| 3,864,873 | 2/1975 | Watkins | 46/232 |

*Primary Examiner*—F. Barry Shay
*Assistant Examiner*—Mickey Yu

[57] ABSTRACT

A toy space vehicle having a main body. A door in the upper surface of the main body may be caused to slowly open and close accompanied by sounds simulating the movement of heavy doors. Pods affixed to the main body may be made to slowly open or close accompanied by the same sounds. A gun residing in the main body may be caused to fire and aircraft residing in the pods to be launched when the doors are opened.

6 Claims, 7 Drawing Figures

SPACE TOY

BACKGROUND OF THE INVENTION

The background of the invention will be discussed in two parts:

1. Field of the Invention

This invention relates to toys and, more particularly, to toys which represent space vehicles.

2. Description of the Prior Art

There have been a myriad of toys developed over the years for use by children of all ages. Many of these toys have become classics and have been reproduced again and again. Those toys which have lasted have certain common characteristics. First, they provide a substantial amount of excitement for the child. Second, they are well made and durable so that the child may play with them over a long period of time. Next, they are sufficiently inexpensive that they appeal to a broad market. Meeting all of these criteria has posed a substantial problem for many prior art toys.

There has been a recent resurgence of interest in outer space in a number of fields, including the toy field. There have been many space related toys devised over the years. In general, those toys which emulate space ships are simply three dimensional, artistic renderings which perform no mechanical functions. If they do operate, the functions are usually quite simple. Consequently, prior art space toys usually entertain for but a short time and fall into disuse.

It is an object of this invention to provide a new and improved toy representing a space ship.

It is another object of this invention to provide a space toy capable of performing a substantial number of complicated operations associated with space travel.

It is still another object of this invention to provide a space toy which exhibits extreme realism in performing a number of complicated functions associated with space travel.

SUMMARY OF THE INVENTION

The foregoing and other objects of the invention are accomplished by a toy designed to be an especially realistic three-dimensional model of a space vehicle capable of accomplishing a number of functions ordinarily associated by the public with the operation of such a vehicle. More specifically, the vehicle is provided with a set of bay doors on its upper surface which, when actuated, swing slowly open accompanied by sounds representing the mechanical openings of large doors. As the bay doors open, a laser gun is raised therethrough. Upon pushing a fire button, gun fire noises are heard while an indicator flashes. The vehicle also has a pair of launching pods which, when actuated, swing open accompanied by sounds simulating the opening of such doors to reveal fighter aircraft ready to be launched. Upon actuation of a launching mechanism, the fighter aircraft are propelled from the pods. Both the operation of closing the bay doors and the pod doors is accomplished by sounds simulating such closings.

Other objects, features, and advantages of the invention will become apparent from a reading of the specification taken in conjunction with the drawings in which like reference numerals refer to like elements in the several views.

DESCRIPTION OF THE PREFERRED EMBODIMENT

Figure 1:
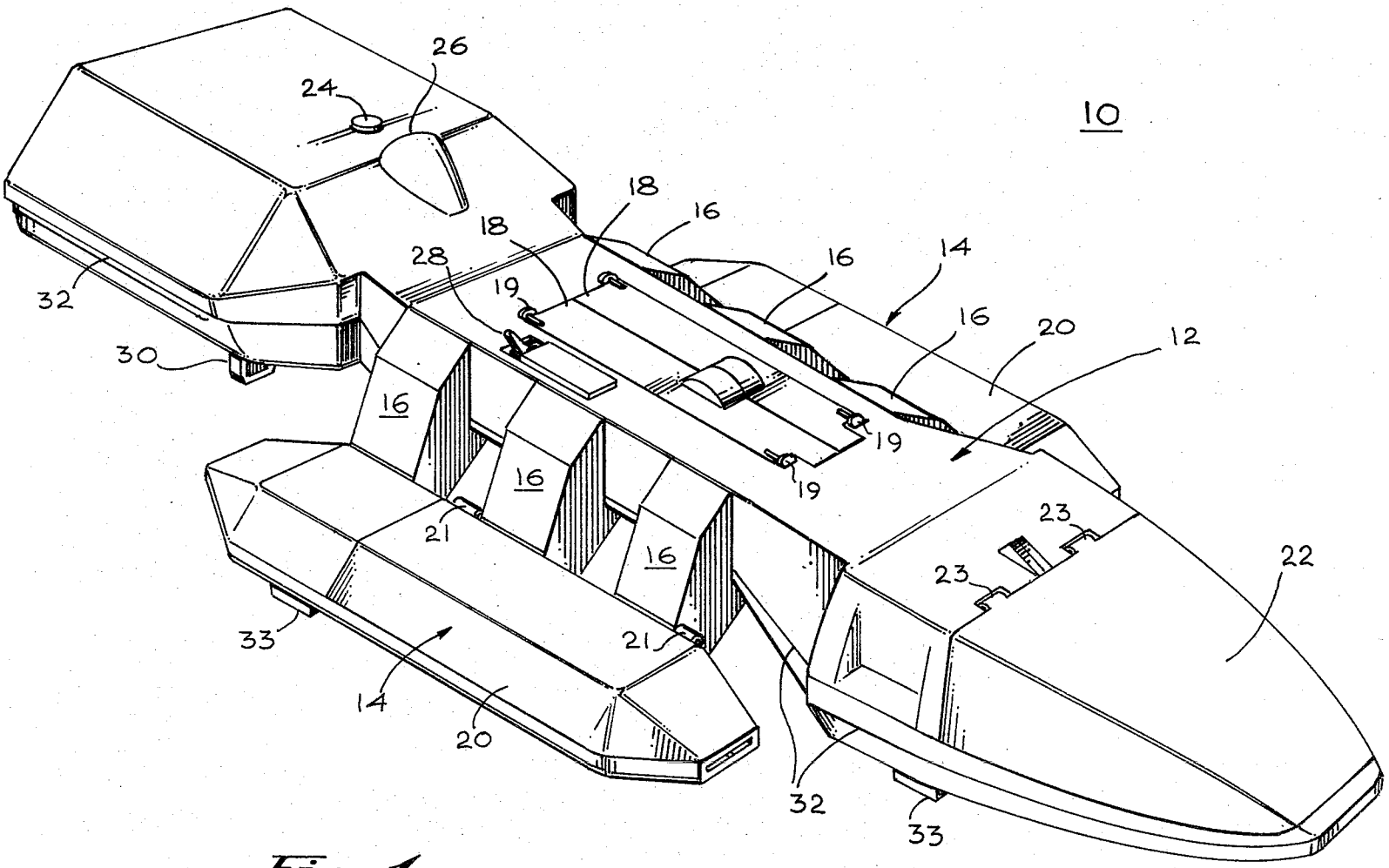
FIG. 1 is a perspective view of a space vehicle constructed in accordance with the invention.

Referring now to the drawings and, more particularly, to FIG. 1, there is shown a perspective view of a space vehicle 10 constructed in accordance with the invention. The space vehicle 10 (which is referred to herein as space ship) has a main body 12 from which project a pair of launching pods 14 each of which is supported to the body 12 by hollow supporting members 16. A pair of bay doors 18 are positioned on the upper surface of the main body 12 and are rotatably mounted thereto by hinges 19. Each of the pods 14 has a front upper portion covered by a pod door 20 which is rotatably mounted by hinges 21 thereto.

A door 22 is rotatably mounted by hinges 23 to the upper surface of the front of the main body 12. To the rear of the main body 12 is positioned a button 24 which among other things operates to light a display 26. Projecting from the upper surface of the main body 12 is a switch 28 which assists in selecting a particular mechanical operation to be accomplished by the space vehicle 10. An actuator 30 projects from the lower rear of the main body 12. Also projecting below the main body 12 are supports 33 which may contain wheels for moving the vehicle 10.

The main body 12 is manufactured so that it has two large exterior body portions which are held together by conventional snap means and which divide along a line 32 shown in FIG. 1. These portions may be manufactured by well-known techniques from moldable plastic materials to provide an especially realistic outer shell for the space vehicle 10. Most of the other portions of the exterior of the vehicle 10 may in like manner be molded from moldable plastic materials so that the space vehicle 10 is a realistic model of a space ship.

Figure 2:
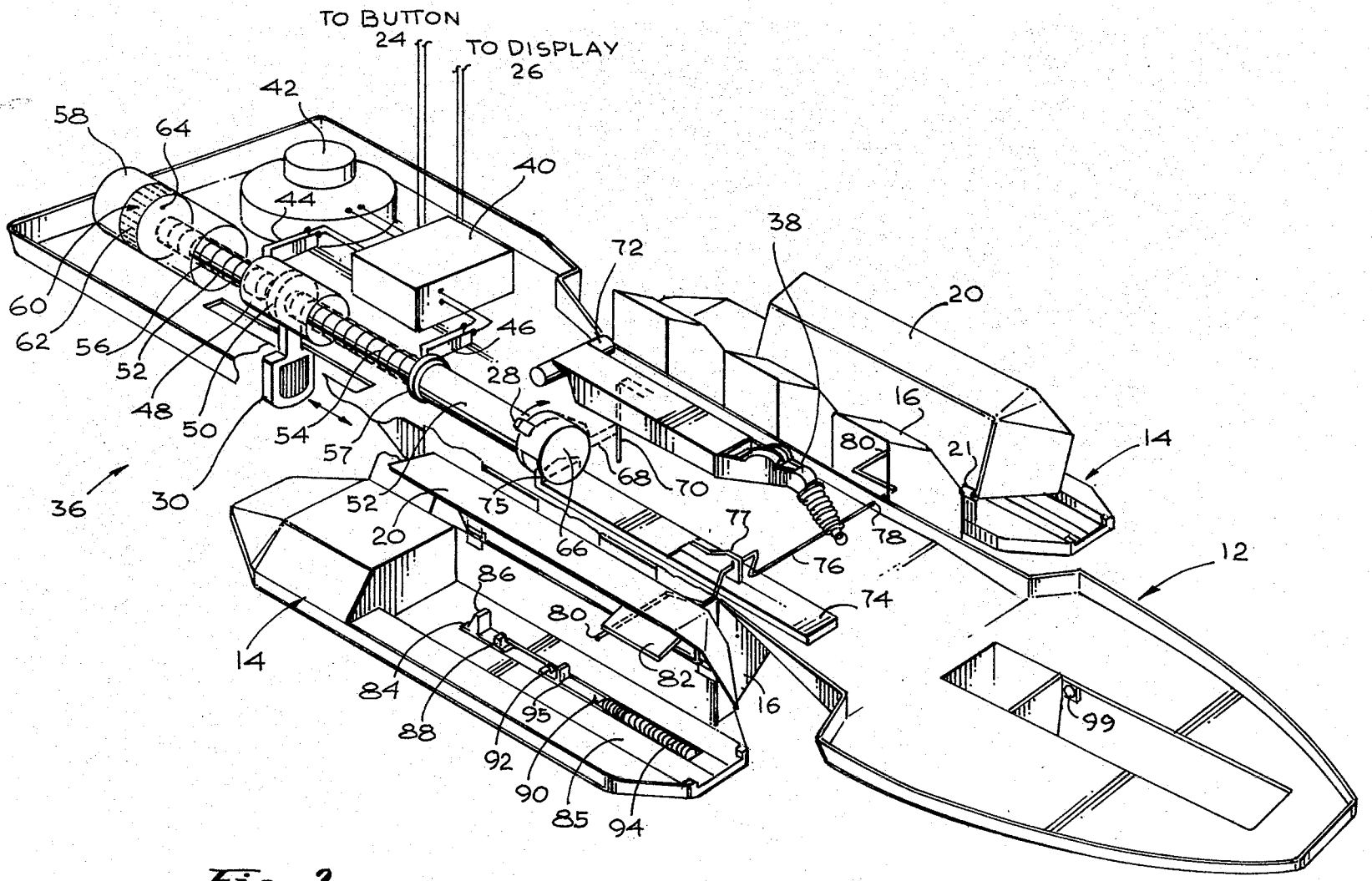
FIG. 2 is a perspective view of the space vehicle shown in FIG. 1 with the top body portion thereof removed to reveal the inner mechanism.

When the upper portion of the main body 12 is removed, the interior mechanism of the space vehicle 10 is revealed as shown in FIG. 2. The lower portion of the body 12 has positioned therein the switch 28 and the actuator 30 shown in FIG. 1. Both of these elements are portions of an actuator mechanism 36. Also positioned in the body 12 are a laser gun 38, circuitry 40, a speaker 42, and various other elements. The circuitry 40 comprises electronic circuitry for producing sounds at a particular frequency. Such circuitry is well known in the art. For example, electronic oscillating circuits may be used to produce signals at a particular frequency which will emulate the desired sounds of bay doors opening, of gun fire, of airplane launchings, and the like.

In a preferred embodiment these circuits may be reproduced on miniature circuit boards so that they may be enclosed within a very small volume in the interior of the main body 12. Input to the circuitry 40 is provided through wires which connect to the button 24 (on the upper surface of main body 12) and switches 44 and 46 the operation of which will be explained hereinafter. All of these inputs essentially close circuits which cause sound generators to provide an output for the speaker 42, shown connected to the circuitry 40. The button 24 also causes the circuitry 40 to close and cause a light in display 26 to flash on until the button 24 is released. This may be accomplished by well known means such as closing a switch to a battery. The operations of the circuitry 40 are arranged to match the mechanical operations of the space vehicle 10 to provide especially realistic simulation of a space ship, as will be explained hereinafter.

The actuator 30 is connected to a cylinder 48 which is essentially hollow but has a central disk like flange 50 positioned therein with a hole through which slides a rod 52. The rod 52 is surrounded by a first spring 54 to the right of the cylinder 48 and by a second spring 56 to the left of the cylinder 48. The spring 54 presses upon one side of the flange 50 and upon an enlargement 57 toward the right end of the rod 52. The rod 52 at its left end projects into a cylinder 58 and drives a piston 60 adapted to move in the cylinder 58. The piston 60 has a seal 62 abouts its outer periphery which provides a tight fit within the cylinder 58. The spring 56 bears upon the surface of the piston 60 and upon the left side of the flange 50. The piston 60 may be provided with a hole 64 adapted to release air at a predetermined rate.

The right end of the rod 52 carries the mechanical switch 28 which projects above the surface of the main body 12 (see FIG. 1). The switch 28 is connected to a selector 66 to which is joined an arm 68. The selector 66 is connected to the rod 52 to rotate about the axis of the rod 52. The switch 28, the selector 66, and the arm 68 function to select which of the particular mechanical functions is to be accomplished by the space vehicle 10.

As may be seen in FIG. 2, when the actuator 30 is pushed to the right, the cylinder 48 will move to the right until it meets and closes the switch 46 thereby causing the circuitry 40 to generate a signal at a frequency such as to emulate the opening of large mechanical doors. With the cylinder 48 in the position described, the spring 54 will exert a substantial pressure on the enlarged ring 57 forcing the rod 52 to the right. Although the spring pressure would tend to cause the rod 52 to move immediately to the right, the action is inhibited and slowed substantially by the action of the piston 60 within the cylinder 58. Consequently, if the actuator 30 is moved to the right and held there, the spring 54 causes the rod 52 to move slowly to the right while a sound simulating the opening of a large mechanical door is generated. When the actuator 30 is moved to the left and held, the cylinder 48 moves to a position where it closes the switch 44 causing the same sound as that generated by closing the switch 46. In this position, the spring 56 presses against the surface of the piston 60 and causes a slow movement of the piston 60 and the rod 52 to the left. When the actuator 30 is released from either the left or the right position, the switches 44 and 46 are opened so that the sound of large doors moving ceases and the force moving the rod 52 is removed.

Figure 5:
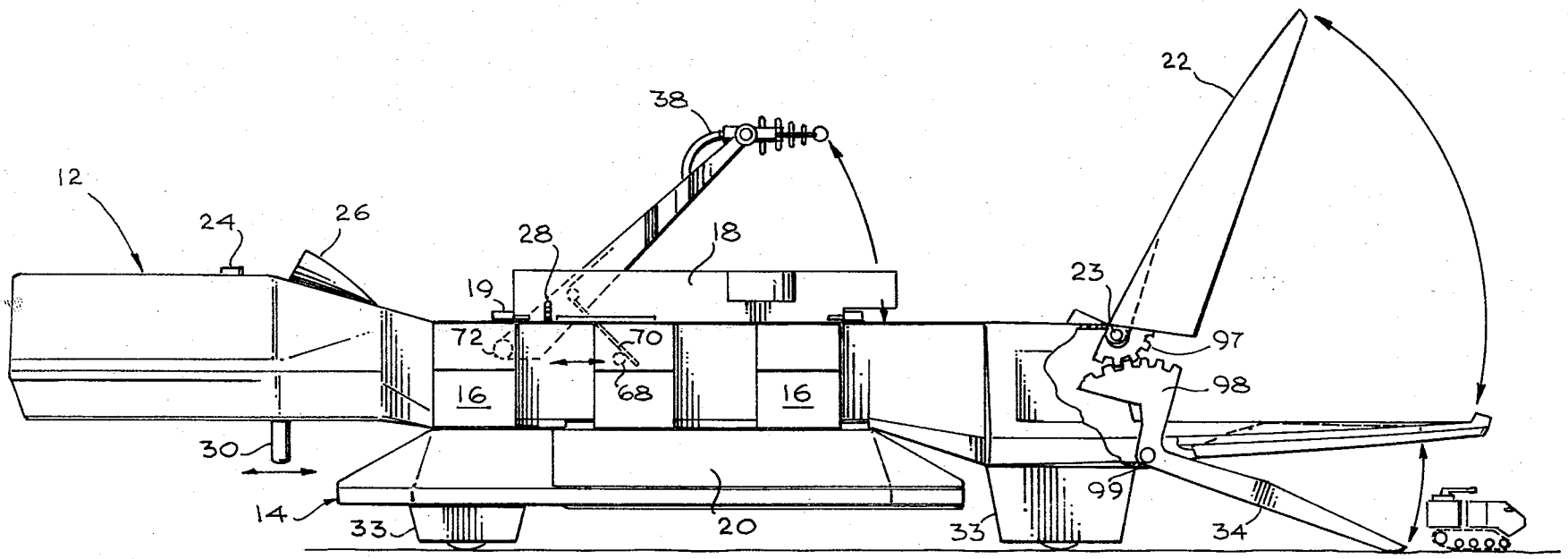
FIG. 5 is a side view of the invention shown in FIG. 1 with the bay doors open and the laser gun projecting.

As the rod 52 moves to the right, two mechanical actions may take place. With the switch 28 positioned as shown in FIG. 2, the arm 68 projects at essentially a horizontal angle from the selector 66 and moves toward the front of the body 12 against a spring 70 which is affixed to the laser gun 38. The laser gun 38 is connected by pivot 72 to the interior of the body 12 so that pressure to the right on the spring 70 causes the laser gun 38 to rotate upwardly about the pivot 72 and force the bay doors 18 (shown in FIG. 1) upward. The laser gun 38 rises until the rod 52 reaches the limit of its extension to the right as the ring 57 contacts the support to the body 12. In this position, which is better shown in FIG. 5, the button 24 may be depressed causing the display 26 to light and the circuitry 40 to generate a sound emulating the firing of a laser gun. It should be noted that the spring 70 holds the laser gun 38 up and the bay doors 18 open and provides a margin of safety for shocks to these members.

The laser gun 38 may be caused to recede within the body 12 and the bay doors 18 to close by pressing the actuator 30 to the left so that the switch 44 is closed and the arm 68 moves to the left. Closing the switch 44 causes the generation of the sound which simulates the movement of a heavy mechanical door while moving the arm 68 to the left (in the Figure) relieves the pressure on spring 70 allowing the laser gun 38 to fall slowly within the body of the ship. In a particular embodiment (not shown), the bay doors 18 may be urged inwardly by light springs at the hinges 19 securing their closure.

Figure 4:
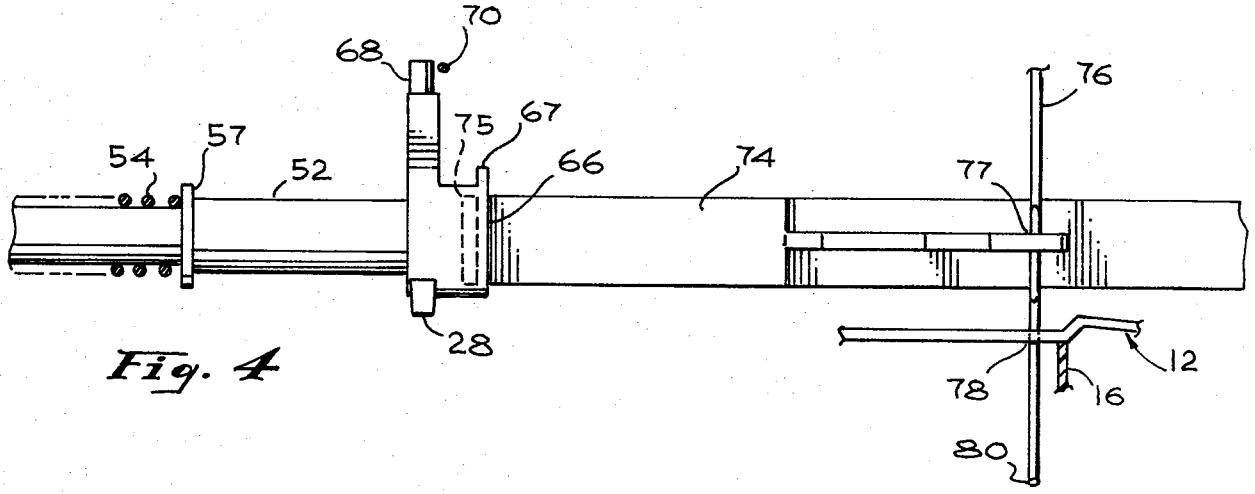
FIG. 4 is a top view of the actuating mechanism shown in FIG. 3.
Figure 3:
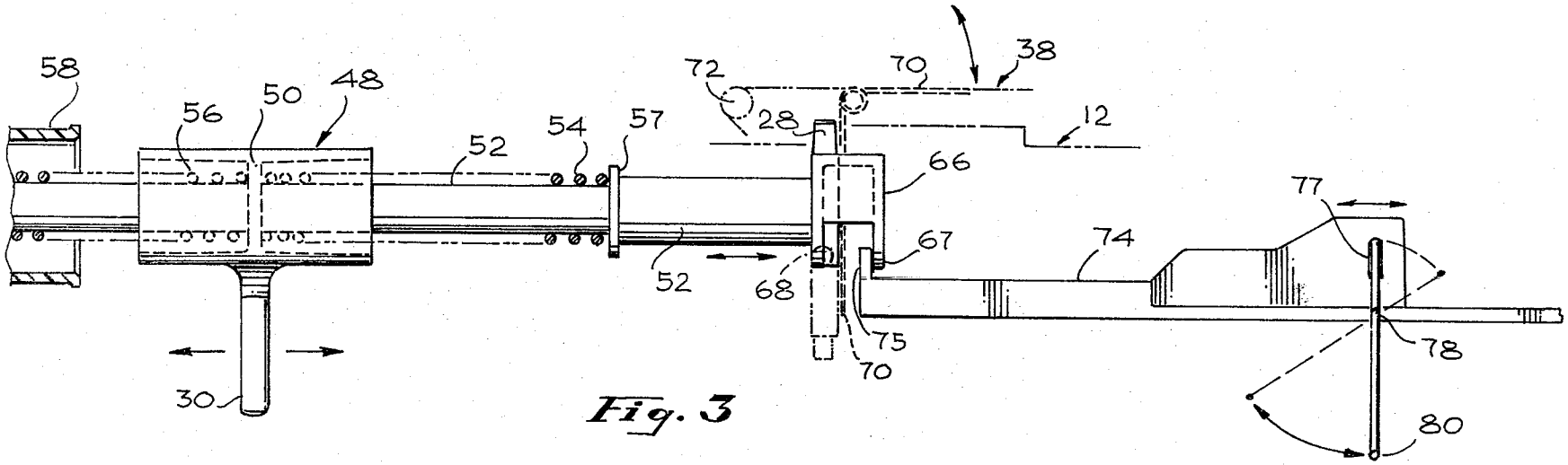
FIG. 3 is a side view illustrating details of the actuating mechanism by which the various doors are opened.

The operation of the switch 28 by rotating it about the axis of the rod 52 toward the top of FIG. 2 will cause the selector 66 to rotate and carry with it the arm 68. The arm 68 is rotated downwardly approximately 70 degrees so that it will no longer contact the spring 70 as the rod 52 moves to the right. The construction of the selector 66 and the rod 68 are also shown in FIGS. 3 and 4 which more clearly illustrate the construction of the actuator mechanism 36. As may be seen in FIG. 3, the selector 66 has a front lip 67 which rotates downwardly over a slide 74 to engage a flange 75. In the down position, the arm 68 also presses against the left hand edge of the slide 74 so that when the rod 52 is driven to the right, the slide 74 moves with it. The slide 74 supports a pivot 77 connected so that it turns a crank 76 pivoted at points 78 in the two sides of the lower portion of the body 12. The crank 76 projects through the pivot points 78, continues through the forward ones of the supporting members 16 (shown in FIG. 1) and into each of the pods 14. In each pod 14, the crank 76 bends at a first right angle and then at a second right angle so that it projects finally into the pod at an end 80 which is parallel to the main body of the crank 76. As the rod 52 moves the slide 74 to the right, the portion of the crank 76 which is connected to the pivot 77 moves forward so that the ends 80 rotate toward the rear of the body 12 and upward. The ends 80 apply upward pressure against a flange 82 which depends from the inner surface of the pod door 20. As the end 80 bears against the flange 82 and presses upwardly, it causes the flange 82 to urge the pod door 20 to open upon its hinges 21. As explained above, the door opening is accompanied by the sound generated as the rod 52 closes the switch 46, the sound of a large metal door opening.

Pushing the actuator 30 to the left while the switch 28 is in position to generate the slide 74 causes the rod 52 to withdraw to the left. The rod 52 pulls the selector 66 which has lip 67 urging flange 75 to the left (as shown in FIG. 2). Consequently, the slide 74 is drawn slowly to the left rotating the crank 76 so that the ends 80 move downwardly. The downward movement of the ends 80 lowers the pod doors 20 causing them to close. Coincidentally, the switch 44 has been closed by the movement of the actuator 30 so that the closure is accompanied by the sounds emulating metallic doors closing.

Figure 6:
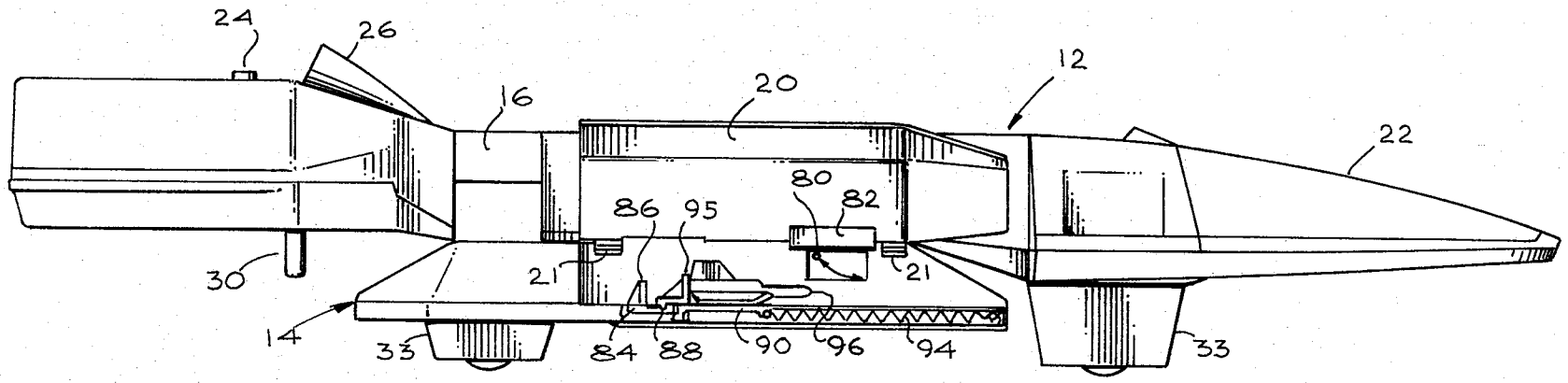
FIG. 6 is a side view of the invention shown in FIG. 1 with the pod doors open and an aircraft poised therein for takeoff.
Figure 7:
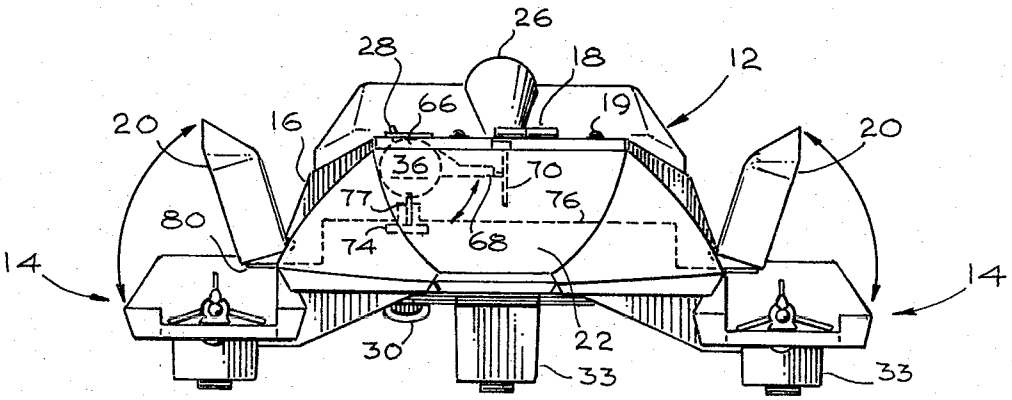
FIG. 7 is a front view of the invention shown in FIG. 1.

When its pod door 20 has been opened, each of the pods 14 displays within its interior a mechanism for launching a fighter aircraft or other projectile. This mechanism includes a spring which may be a portion of a base 85 of the interior of the pod 14 and which carries a button 86 which when depressed moves a hook 88 in a downward direction. The hook 88 is adapted to fasten in a catch 92 of a launcher which slides in a channel in the base 85. The launcher 90 is connected by a spring 94 to the forward end of the pod. An actuating mechanism 95 may be pressed to the left to cause the catch 92 to connect the hook 88. If a small toy aircraft such as that shown in FIG. 6 is positioned against the actuator 95 and the button 86 is pressed, the launcher 90 will be released and project the aircraft 96 to the right as shown in FIGS. 2 and 6.

Heightening the realism of the space vehicle 10 is the front door 22 which opens manually by lifting the front portion thereof about the hinges 23. The front door 22 has affixed thereto and rotating about the axis of the hinges 23 a section of a gear 97. The gear 97 meshes with a gear 98 which is affixed to a lower door 34, hinged to the lower portion of the body 12 at 99 so that as the front door 22 is opened the lower door 34 also opens and provides a ramp for lowering ground vehicles from the interior body of the space vehicle 10 to the surface.

As has been described, the space vehicle 10 is a very realistic model of what the public might expect of a space ship. The space vehicle 10 has the center bay doors which open so that a laser gun projects while providing the sound of bay doors opening. It has side pod doors which open accompanied by realistic sounds to reveal fighter aircraft which may be launched. The vehicle 10 provides the same sounds as the bay doors and the pod doors are closed. Furthermore, the vehicle 10 provides sounds emulating the firing of a laser gun upon the depression of the button 24 when the laser gun is in the upright position. This is accompanied by the lighting of the display 26. All of these integrated actions of the space vehicle 10 heighten its realism and provide a very exciting toy for a child.

As explained above all of the exterior body portions of the vehicle 10 may be made of molded plastic and may be constructed by well known techniques. Furthermore, the laser gun 38, the lower door 34, and those portions of the interior of the body 12 which support the mechanism may be constructed in a like manner of moldable plastic material by well known techniques. The various portions of the mechanism 36 may optimumly be constructed of a material such as nylon which will provide the close tolerances and easy fit for the desired motions. On the other hand, the springs 54, 56, 70 and 94 are preferably constructed of a spring metal. The seal 62 surrounding the piston 60 may be of a soft rubber or other material well known in the art for providing the desired seal.

Obviously, other materials and construction techniques could be used to provide a space vehicle such as that described herein. Furthermore, various changes might be made in the form of the space vehicle without departing from the inventive concepts. Thus, while there has been shown and described a preferred embodiment, it is to be understood that various other adaptations and modifications may be made which fall within the spirit and scope of the invention.

What is claimed is:

1. A toy having a main body; a door affixed to the main body; means for mechanically opening the door including a rod, a spring wound about the rod, means for affixing one end of the spring to the rod, means for urging the spring along the axis of the rod, means for slowing the movement of the rod along its axis, and means attached to the rod for moving the door; and means for simulating the sound of a door moving while the door is opening.

2. A toy as claimed in claim 1 in which the means for moving the door comprises an arm projecting from the rod, a member pivotably mounted adjacent the door in a position to move the door as it rotates, and a spring mounted to the member with one end extending therefrom to a position such that movement of the arm urges the spring to rotate the member.

3. A toy as claimed in claim 1 in which the means for moving the door comprises an arm projecting from the rod, a slide positioned to move in response to motion of the arm, and crank means operated by the slide to urge the door to move.

4. A toy as claimed in claim 2 further comprising a second door, and in which the means for moving the door includes a mechanical switch for selectively opening the second door instead of the first door.

5. A toy as claimed in claim 2 in which the member simulates a gun and projects through the door when open.

6. A toy as claimed in claim 2 further comprising means for simulating gunfire.

* * * * *